US006327800B1

(12) United States Patent
Daams

(10) Patent No.: US 6,327,800 B1
(45) Date of Patent: Dec. 11, 2001

(54) IRONING BOARD

(75) Inventor: Rudolphus Cornelis Henricus Daams, Eindhoven (NL)

(73) Assignee: Brabantia Nederland B.V., Waalre (NL)

( * ) Notice: Subject to any disclaimer, the term of this patent is extended or adjusted under 35 U.S.C. 154(b) by 0 days.

(21) Appl. No.: 09/622,182

(22) PCT Filed: Feb. 11, 1999

(86) PCT No.: PCT/NL99/00070

§ 371 Date: Aug. 14, 2000

§ 102(e) Date: Aug. 14, 2000

(87) PCT Pub. No.: WO99/41445

PCT Pub. Date: Aug. 19, 1999

(30) Foreign Application Priority Data

Feb. 13, 1998 (NL) ..... 1008300

(51) Int. Cl.[7] ..... D06F 81/02
(52) U.S. Cl. ..... 38/137
(58) Field of Search ..... 38/137, 170

(56) References Cited

U.S. PATENT DOCUMENTS 2,235,882 * 3/1941 John ..... 38/137
2,235,883 * 3/1941 John ..... 38/137
2,291,614 8/1942 Fay .
2,498,176 * 2/1950 Nelson et al. ..... 38/137
2,687,587 8/1954 Strom et al. .
5,272,825 12/1993 Simpson .

* cited by examiner

*Primary Examiner*—Ismael Izaguirre
(74) *Attorney, Agent, or Firm*—Young & Thompson

(57) ABSTRACT

The ironing board includes an underframe, a table frame, fitted to the underframe and at least broadly flat and having a table rim which is formed from an edge profile, and an ironing board table having an essentially flat top surface, which ironing board table, close to the periphery, is mounted on supporting portions of the table rim, At the periphery the ironing board table is held with a clearance between stop portions of the table rim, which delimit a displacement of the ironing board table in a direction parallel to the top surface thereof. The total clearance (2*s*) parallel to the top surface of the ironing board table has an order of magnitude of at most 4–5 mm. The edge profile of the table rim can include a part in the form of a horizontal U having two horizontal arms and a vertical connecting part between the two arms, that the supporting portions of the table rim are formed by a first horizontal arm of the U, that the stop portions of the table rim are formed by the connecting part between the arms of the U, and that the second horizontal arm of the U extends over the periphery of the ironing board table, such that the periphery of the ironing board table, in a direction perpendicular to the top surface, is encased in the edge profile essentially with no or only minor clearance (t).

5 Claims, 2 Drawing Sheets

IRONING BOARD

FIELD OF THE INVENTION

The invention relates to an ironing board.

BACKGROUND OF THE INVENTION

Ironing boards are commonly known. The ironing board table generally previously consisted of wood or of wood-like products such as plywood or chipboard, but for some time now has also often preferably consisted of a metal grid. Grids of this type are light and moisture-permeable owing to the many openings present. They are also firm enough, possibly with the aid of stiffening in the frame of the ironing board, which stiffening is fitted beneath the grid, to absorb the forces which are generated during ironing.

A possible drawback of the use of steel ironing board tables which can be cited is the relatively high coefficient of thermal expansion of metal. Under the influence of the heat of the iron and possibly of steam generated during ironing, the grid can be deformed such that it assumes in places a somewhat convex form under the influence of the induced thermal compression stresses. The nature of the ironing process naturally dictates that the ironing board should preferably be totally smooth and should exhibit no local bulges. In principle, ironing board tables which are not made of metal can also exhibit bulges as the result of compression stresses generated parallel to the ironing board table.

SUMMARY OF THE INVENTION

The object of the invention is an ironing board with which the problems resulting from the stresses are overcome.

The inventive ironing board includes:

an underframe; a table frame, fitted to the underframe and at least broadly flat and having a table rim which is formed from an edge profile and including stop portions; an ironing board table having an essentially flat top surface, which ironing board table, close to the periphery, is mounted on supporting portions of the table rim; the stop portions of the table rim delimit a displacement of the ironing board table in a direction parallel to the top surface thereof; and clearance(s) between the periphery of the ironing board table and the stop portions of the table rim.

The ironing board table preferably comprises a metal grid and the total clearance (2*s*) parallel to the top surface of the ironing board table has an order of magnitude of at most 4–5 mm.

Preferably, the edge profile of the table rim comprises a part in the form of a horizontal U having two horizontal arms and a vertical connecting part between the two arms; the supporting portions of the table rim are formed by a first horizontal arm of the U; the stop portions of the table rim are formed by the connecting part between the arms of the U; and the second horizontal arm of the U extends over the periphery of the ironing board table, such that the periphery in a direction perpendicular to the top surface, is encased in the edge profile essentially with no or only minor clearance (t).

Preferably, the ironing board table has on the periphery a portion which is staggered relative to the other part of the top surface; and the other part of the top surface and the corresponding top surface of the table rim lie essentially in the very same flat plane.

A cover mat covers the ironing board table, the cover mat extends at the periphery over the second horizontal arm of the edge profile of the table rim.

replace the last paragraph bridging pages 1 and 2 as follows:

For a practical case, the clearance can amount to a few tenths of a millimetre, for example, which is generally sufficient. Too large a clearance causes structural problems and possibly even results in unwanted "rattling" of the table within the table frame.

By fitting the ironing board table correctly in the table frame in accordance with the invention and such that there is clearance present between those parts of the table rim which act as a stop whenever the board table is displaced in a direction parallel to the surface, an ironing board can be obtained which, in accordance with the invention, is constructed to allow a thermal expansion of the ironing board table within the table frame, or some differently founded expansion in the transverse direction, without stresses generated in a direction parallel to the ironing board table being able to result in a deformation of the ironing board table.

Preferably, an ironing board according to the invention and having the characteristics of claim 2 is used. For a practical case, the said clearance can amount to a few tenths of a millimetre, for example, which is generally sufficient. Too large a clearance causes structural problems and possibly even results in unwanted "rattling" of the table within the table frame.

This effect can be enhanced by a following embodiment possessing the characteristics of claim 5.

BRIEF DESCRIPTION OF THE DRAWINGS

The invention will now be explained, solely by way of example, with reference to the schematic drawing of an illustrative embodiment, in which.

DETAILED DESCRIPTION OF THE PREFERRED EMBODIMENTS

Figure 1:
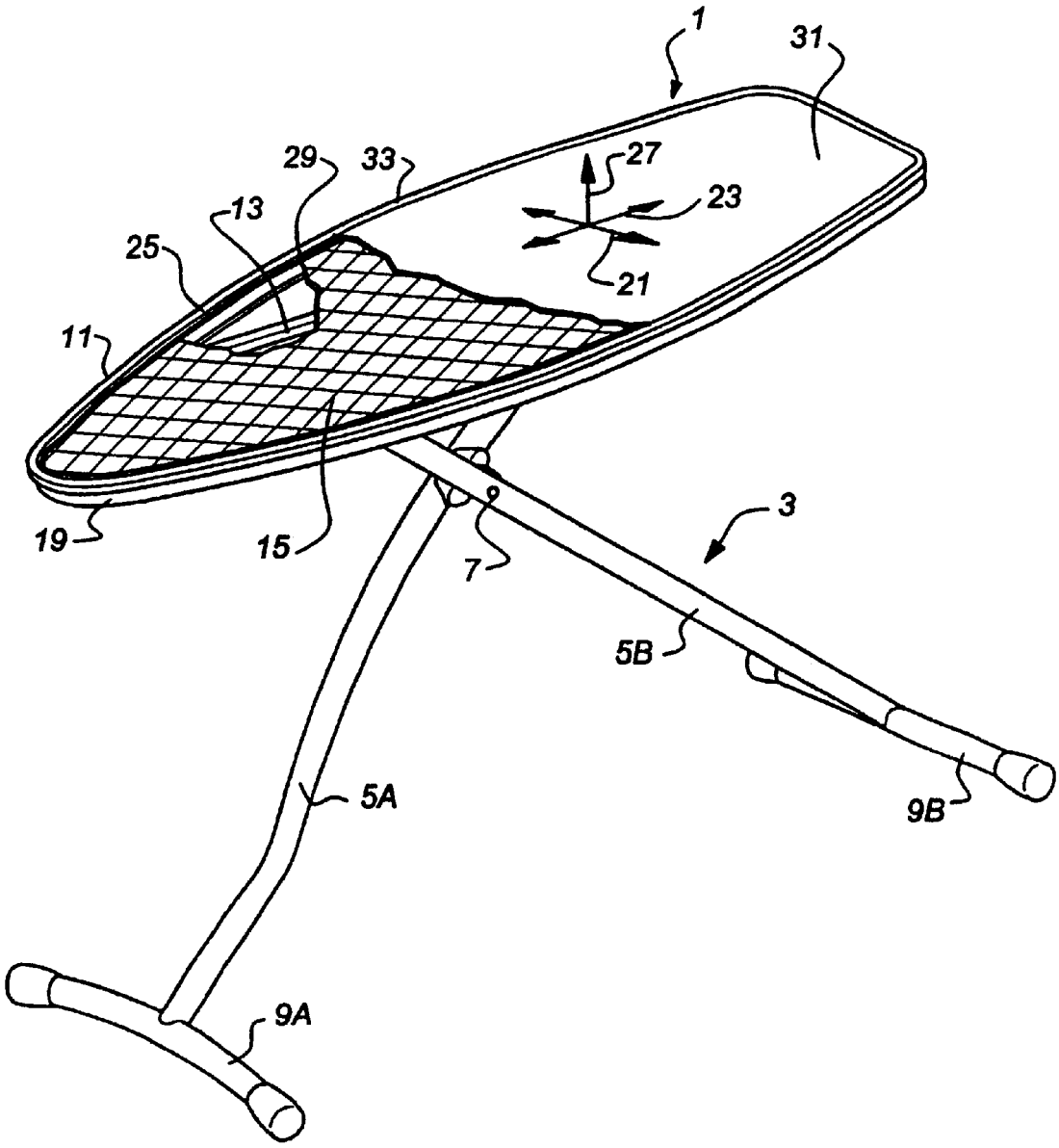
FIG. 1 is a perspective view obliquely from above onto an ironing board according to the invention, which is covered by a cover mat which is locally partially removed to show the underlying grid, the underlying grid also having been partially cut away to show the local shape of the table frame.

FIG. 1 shows an ironing board 1 for ironing washing and the like, which ironing board is provided with an underframe 3 having a pair of leg elements 5A and 5B which are hinged together at 7. At the ends of the legs there are supports 9A,B to enable the ironing board to be placed firmly on a floor. Such an underframe is wholly conventional in type and is of no importance to the invention per se. A detailed description of the underframe and the locking thereof relative to the other parts of the ironing board shall therefore be omitted.

To the underframe 3 there is fitted an at least essentially flat frame, having a table rim 11 formed from a metal edge profile. The table frame can also contain further components; FIG. 1 shows, for example, a portion of a metal stiffening profile 13. An ironing board table 15 having an essentially flat top surface is additionally present, which ironing board table, near the periphery, is mounted on supporting portions 17 of the table rim 11, see especially FIG. 2 in this regard.

Figure 2:
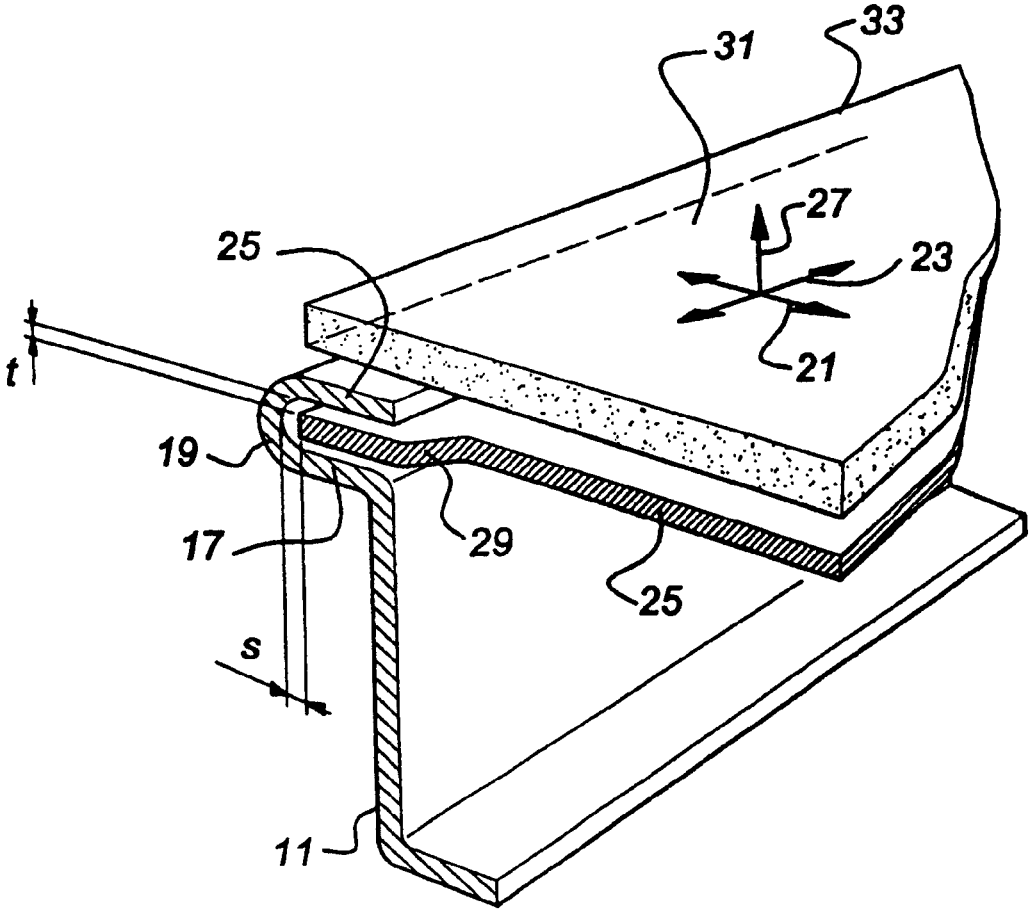
FIG. 2 is a cross-section of a portion of the ironing board at the location of the table rim.

At the periphery, the ironing board table 15, see primarily FIG. 2, is held with a clearance s between stop portions 19 of the table rim. These stop portions delimit a displacement of the ironing board table 15 in directions parallel to the top surface thereof, especially in the transverse direction indicated by a double arrow 21 and longitudinal direction indicated by a double arrow 23.

The ironing board table 15 consists in a known manner of a metal grid. The total clearance 2*s* parallel to the top surface of the ironing board table 15 has an order of magnitude of at most 4–5 mm, but lies preferably within the realm of a few tenths of a mm. This is in order to avoid unnecessary movements and possibly even rattling of the ironing board table in the table frame.

The edge profile of the table rim 11 comprises a part in the form of a horizontal U, see especially FIG. 2 once again. This part comprises two horizontal arms 17 and 25 and between them a vertical connecting part 19. This connecting part can, for example, be semicircular, see FIG. 2.

The horizontal arm 17 of the U forms the aforementioned supporting portions of the table rim, on which the ironing board table 15 is mounted close to the periphery. The connecting part 19 between the arms 17 and 25 of the U forms the aforementioned stop portions of the table rim, which delimit a displacement of the ironing board table in the directions 21 and 23. The second horizontal arm 25 of the U extends to above the periphery of the ironing board table 15. Everything is constructed such that the periphery of the ironing board table 15, in the direction 27 perpendicular to the top surface, is encased in the edge profile 11 essentially with no or only minor clearance t. This clearance can be equal to nought as long as care is taken to ensure that the bearing pressure between the second horizontal arm 25 of the edge profile and the top surface of the ironing board table 15 is not such that the ironing board table is prevented from expanding into the clearance s. Moreover, no unwanted noises or deformations should, of course, occur.

The ironing board table 15 has on the periphery a portion 29 which is staggered relative to the other portion of the top surface. This portion is staggered relative to the top surface of the ironing board table 15 over a distance which is essentially equal to the thickness of the second horizontal arm 25 of the edge profile 11, measured at the clearance t, so that the top surface of the table rim 11, i.e. the top surface of the second horizontal arm 25, lies essentially in the same flat plane as the top surface of the greatest part of the ironing board table 15.

As can be seen in both FIG. 1 and FIG. 2, the ironing board table 15 is covered by a cover mat 31. Cover mats of this type are common and can consist, for example, of a felt or of a textile top layer, with beneath it a layer consisting of a suitable foam plastic, etc. The cover mat 31 extends at the periphery 33 over the second horizontal arm 25 of the edge profile of the table rim 11. The most attractive appearance is obtained when the periphery 23 of the cover mat 31 is placed, over a small distance, towards the inside with respect to the outer edge of the connecting part 19 of the table rim 11.

Although the invention has only been explained with reference to just a single example of an ironing board in accordance with the invention, it should be understood that the invention is not limited to such an embodiment but, on the contrary, embraces all embodiments within the scope of the appended claims. Thus the ironing board can possess a totally different shape and structure, the table rim can be shaped differently and made from a different material and may possibly not possess the smooth continuous shape of the table rim of the ironing board according to the drawing, so that also the stop portions of the table rim, between which the ironing board table is held with clearance, can comprise discrete stops in place of a continuous rim. The same applies to the supporting portions on which the table rim rests. Consideration might be given to giving the ironing board table a different clearance in the longitudinal direction than in the transverse direction, taking account of the other dimensions and of any preferred directions for expansions of the ironing board table used. This latter does not need to consist of metal or a grid. Essential to the invention is only that the ironing board table, at the periphery, is held with clearance in the table rim so that thermal stresses do not cause the ironing board table to bulge.

What is claimed is:

1. An ironing board comprising:

an underframe;

a table frame, fitted to the underframe and at least broadly flat and having a table rim which is formed from an edge profile and including stop portions;

an ironing board table having an essentially flat top surface, which ironing board table, close to the periphery, is mounted on supporting portions of the table rim;

the stop portions of the table rim delimit a displacement of the ironing board table in a direction parallel to the top surface thereof; and clearance(s) between the periphery of the ironing board table and the stop portions of the table rim.

2. The ironing board according to claim 1, wherein the ironing board table comprises a metal grid; and the total clearance (2*s*) parallel to the top surface of the ironing board table has an order of magnitude of at most 4–5 mm.

3. The ironing board according to claim 1, wherein the edge profile of the table rim comprises a part in the form of a horizontal U having two horizontal arms and a vertical connecting part between the two arms;

the supporting portions of the table rim are formed by a first horizontal arm of the U;

the stop portions of the table rim are formed by the connecting part between the arms of the U; and the second horizontal arm of the U extends over the periphery of the ironing board table, such that the periphery in a direction perpendicular to the top surface, is encased in the edge profile essentially with no or only minor clearance (t).

4. The ironing board according to claim 3, wherein the ironing board table has on the periphery a portion which is staggered relative to the other part of the top surface; and the other part of the top surface and the corresponding top surface of the table rim lie essentially in the very same flat plane.

5. The ironing board according to claim 4, further comprising a cover mat covering the ironing board table, the cover mat extends at the periphery over the second horizontal arm of the edge profile of the table rim.

* * * * *